US009937711B2

(12) United States Patent
Otsuka

(10) Patent No.: US 9,937,711 B2
(45) Date of Patent: Apr. 10, 2018

(54) INKJET PRINTER

(71) Applicant: RISO KAGAKU CORPORATION, Tokyo (JP)

(72) Inventor: Shinichiro Otsuka, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/270,640

(22) Filed: Sep. 20, 2016

(65) Prior Publication Data

US 2017/0087849 A1 Mar. 30, 2017

(30) Foreign Application Priority Data

Sep. 29, 2015 (JP) ..... 2015-191004
Sep. 29, 2015 (JP) ..... 2015-191008

(51) Int. Cl.

| | |
|---|---|
| ***B41J 29/377*** | (2006.01) |
| ***B41J 2/045*** | (2006.01) |
| ***B41J 2/14*** | (2006.01) |
| ***B41J 2/155*** | (2006.01) |

(52) U.S. Cl.

CPC ..... *B41J 2/04515* (2013.01); *B41J 2/1408* (2013.01); *B41J 2/155* (2013.01); *B41J 29/377* (2013.01)

(58) Field of Classification Search

CPC ..... B41J 2/04515; B41J 2/155; B41J 29/377; B41J 2/1408

See application file for complete search history.

(56) References Cited

U.S. PATENT DOCUMENTS 6,390,618 B1 * 5/2002 Wotton ..... B41J 2/215 347/102
2011/0109710 A1 * 5/2011 Miyakoshi ..... B41J 2/165 347/104

FOREIGN PATENT DOCUMENTS

JP 2010-264752 A 11/2010

* cited by examiner

*Primary Examiner* — Julian Huffman
(74) *Attorney, Agent, or Firm* — Hamre, Schumann, Mueller & Larson, P.C.

(57) ABSTRACT

An inkjet printer includes plural inkjet heads that are aligned in a head alignment direction to form a head row, a blower that blows air to the head row from one side along the head alignment direction, and an aspirator that is disposed on an extended line of the head row and on the other side along the head alignment direction for aspirating air through its aspirator port. The aspirator includes a tubular duct that extends from the aspirator port toward the head row.

7 Claims, 17 Drawing Sheets

INKJET PRINTER

BACKGROUND OF THE INVENTION

Technical Field

The present invention relates to an inkjet printer that carries out printing by ejecting inks from its inkjet heads.

Background Arts

Known is an inkjet printer that is provided with plural inkjet heads aligned along a primary sweeping direction and carries out printing by ejecting inks from the inkjet heads while transferring a paper in a secondary sweeping direction.

In an inkjet printer including such a type of the above-mentioned inkjet printer, drive circuits and so on generate heats when driving the inkjet heads. Temperature increase due to the generated heats causes failures of the inkjet heads and so on. Therefore, it is required to cool the inkjet heads.

A Patent Document 1 (Japanese Patent Application Publication No. 2010-264752) discloses an inkjet printer in which two fans are disposed so as to interpose plural inkjet heads aligned along a primary sweeping direction between the two fans. According to the inkjet printer, one of the fans blows air onto the inkjet heads, and the other of the fans suctions the air. By this operation, the inkjet heads are cooled by a cooling air flow generated by the fans.

SUMMARY OF THE INVENTION

However, the cooling air flow may disperse after striking the inkjet heads according to the cooling technique for cooling the inkjet heads as described above. Therefore, its cooling efficiency may decrease.

An object of the present invention is to provide an inkjet printer that can improve cooling efficiency of its inkjet heads.

A first aspect of the present invention provides an inkjet printer comprising: a plurality of inkjet heads that are aligned in a head alignment direction to form a head row; a blower that blows air to the head row from one side along the head alignment direction; and an aspirator that is disposed on an extended line of the head row and on the other side along the head alignment direction, and aspirates air through an aspirator port thereof, wherein the aspirator includes a tubular duct that extends from the aspirator port toward the head row.

According to the first aspect, since the aspirator aspirates air through the tubular duct extending from its aspirator port toward the head row, cooling air flows congregate toward the duct and their flow speed can be increased. Therefore, the closer to a downstream side, the more effectively performance for cooling the inkjet heads can be restricted from degrading. As the result, efficiency for cooling the inkjet heads can be improved.

It is preferable that the head row is provided in a plurality, the plurality of inkjet heads in the plurality of head rows is arranged in a staggered manner, and the inkjet printer further comprises a plurality of plate-shaped straitening tabs each of which is disposed on a side of the one side of each of the inkjet heads in the head alignment direction, and is perpendicular to a horizontal plane and parallel to the head alignment direction.

According to this configuration, dispersion of the cooling air flows can be restricted by the straightening tabs each of which is disposed on a side of the one side of each of the inkjet heads in the head alignment direction, and thereby losses of the cooling air flows can be reduced. Therefore, the efficiency for cooling the inkjet heads can be further improved.

It is preferable that at least one inclined member that is disposed above the head row (above each of the head rows), and has an inclined surface whose one side in the head alignment direction is made higher than the other side.

According to this configuration, the cooling air flows flowing above the head row(s) are introduced into the head row(s) by the inclined members each of which has the inclined surface so that its one side in the head alignment direction is made higher than its other side. Therefore, the efficiency for cooling the inkjet heads can be further improved.

A second aspect of the present invention provides an inkjet printer comprising: a plurality of inkjet heads that are aligned in a head alignment direction to form a head row; a blower that blows air to the head row from one side along the head alignment direction; and an aspirator that is disposed on an extended line of the head row and on the other side along the head alignment direction, and aspirates air through an aspirator port thereof, wherein the head row is provided in a plurality, the plurality of inkjet heads in the plurality of head rows is arranged in a staggered manner, and the inkjet printer further comprises a plurality of plate-shaped straitening tabs each of which is disposed on a side of the one side of each of the inkjet heads in the head alignment direction, and is perpendicular to a horizontal plane and parallel to the head alignment direction.

It is preferable that at least one inclined member that is disposed above each of the head rows, and has an inclined surface whose one side in the head alignment direction is made higher than the other side.

DESCRIPTION OF THE EMBODIMENT

Figure 1:
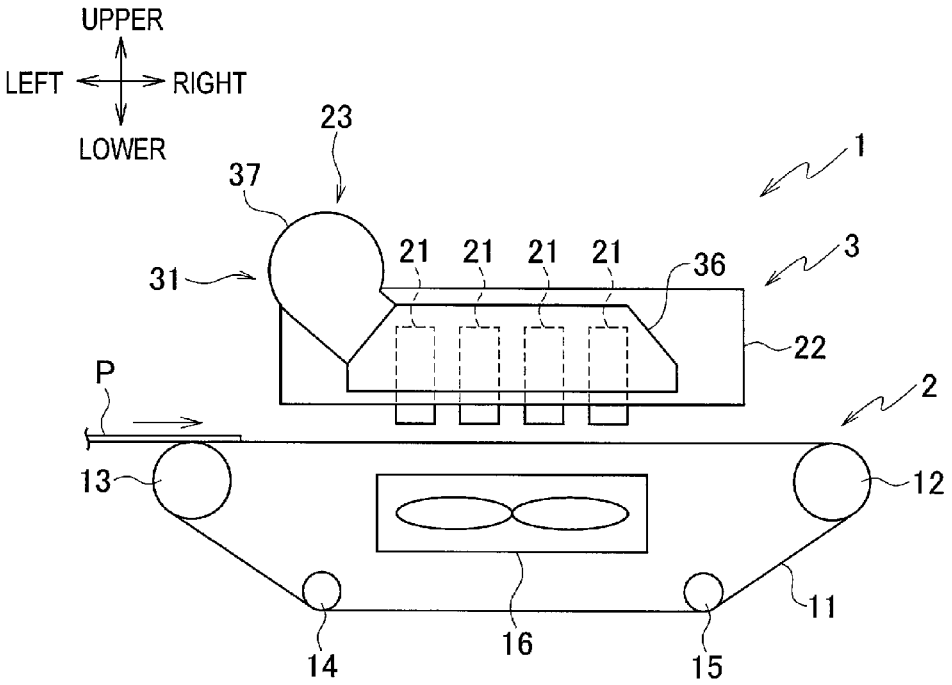
FIG. 1 is a schematic configuration diagram of an inkjet printer according to a first embodiment.

Hereinafter, embodiments of an inkjet printer will be described with reference to the drawings. Equivalent or identical configurational elements in the drawings will be labelled with equivalent or identical reference numbers or signs.

The embodiments that will be described hereinafter are examples of devices and so on that realize technical idea of the present invention. The technical idea doesn't limit material, shape, structure, arrangement and so on of each component to ones in the embodiments. Various modifications can be applied to the technical idea within a scope of the claims.

First Embodiment

In the following descriptions, a direction perpendicular to a paper plane of FIG. 1 is denoted as a front-rear direction, and your side is front. In addition, a vertical direction in FIG. 1 is denoted as an upper-lower direction, and a lateral direction in FIG. 1 is denoted as a left-right direction.

As shown in FIG. 1, an inkjet printer 1 according to a first embodiment includes a transfer unit 2 and a print unit 3.

The transfer unit 2 transfers papers P. The transfer unit 2 includes a transfer belt 11, a drive roller 12, driven rollers 13 to 15, and a paper suctioning fan 16.

A paper P is suctioned onto the transfer belt 11 to be held on it, and transferred by the transfer belt 11. The transfer belt 11 is an endless belt wound around the drive roller 12 and the driven rollers 13 to 15. Plural belt holes (not shown in the drawings) are formed on the transfer belt 11. The transfer belt 11 suctions the paper P onto its upper surface to hold the paper P by suction forces generated at the belt holes by driving the paper suctioning fan 16. The transfer belt 11 is circularly fed in a clockwise direction in FIG. 1, and thereby transfers the paper P rightward.

The drive roller 12 circularly feeds the transfer belt 11 in a clockwise direction in FIG. 1. The drive roller 12 is driven to rotate by a motor (not shown in the drawings).

The driven rollers 13 to 15 support the transfer belt 11 together with the drive roller 12. The driven rollers 13 to 15 are passively rotated by the drive roller 12 via the transfer belt 11. The driven roller 13 is disposed on the left side of the drive roller 12 and at the same height level as that of the drive roller 12. The driven rollers 14 and 15 are disposed at a lower height level than those of the drive roller 12 and the driven roller 13, and at the same height as each other with being distanced from each other in the left-right direction.

The paper suctioning fan 16 generates a downward air flow. Therefore, the paper suctioning fan 16 generates a negative pressure at the bent holes of the transfer belt 11 by suctioning air through the belt holes, and thereby suctions the paper P onto the transfer belt 11. The paper suctioning fan 16 is disposed in a zone surrounded by the endless transfer belt 11.

The print unit 3 prints images on the paper P being transferred by the transfer unit 2. The print unit 3 is disposed above the transfer unit 2. As shown in FIG. 1 to FIG. 4, the print unit 3 includes plural inkjet heads 21, a head holder 22, and a head cooler 23.

Figure 2:
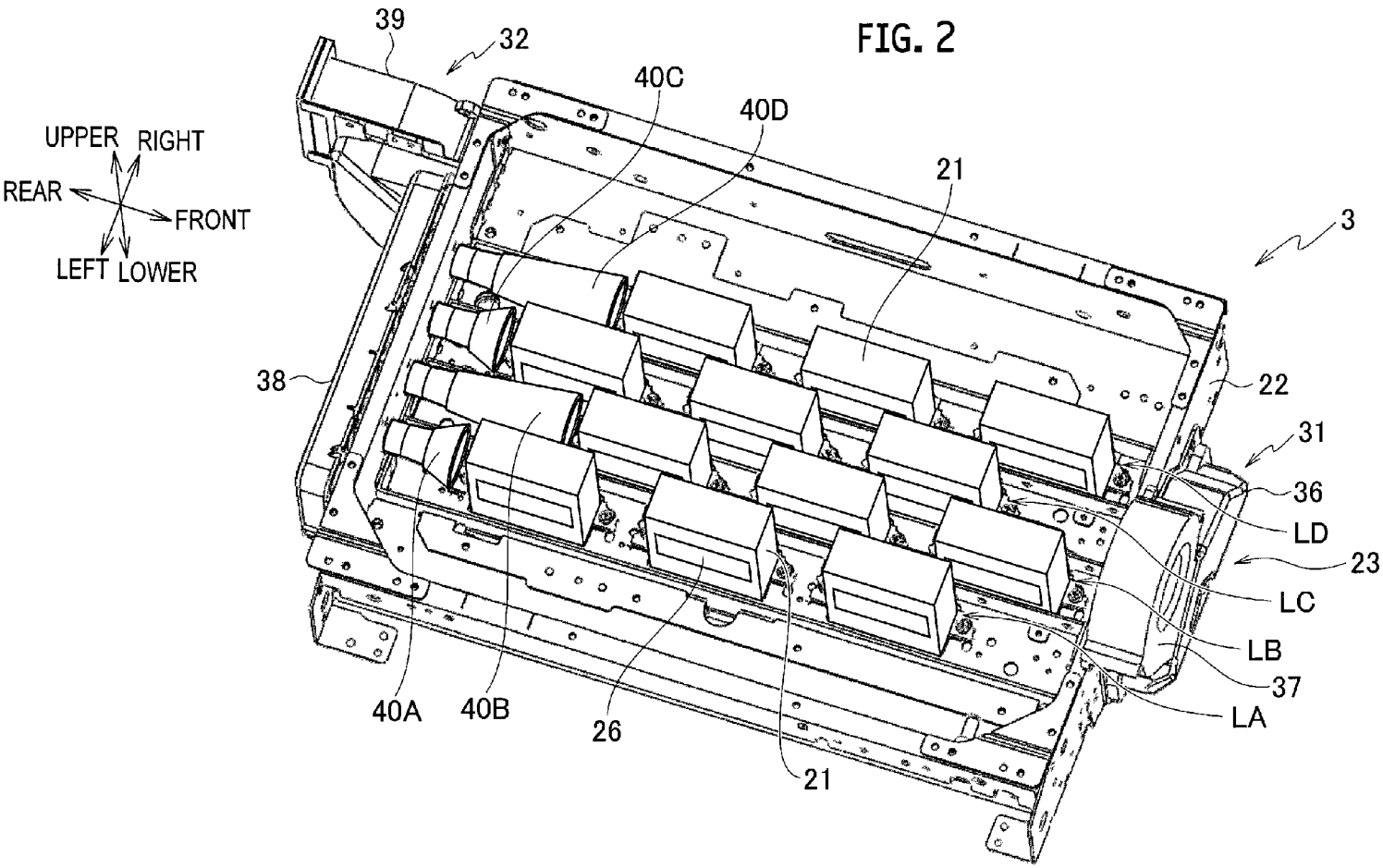
FIG. 2 is a perspective view of a print unit of the inkjet printer.
Figure 3:
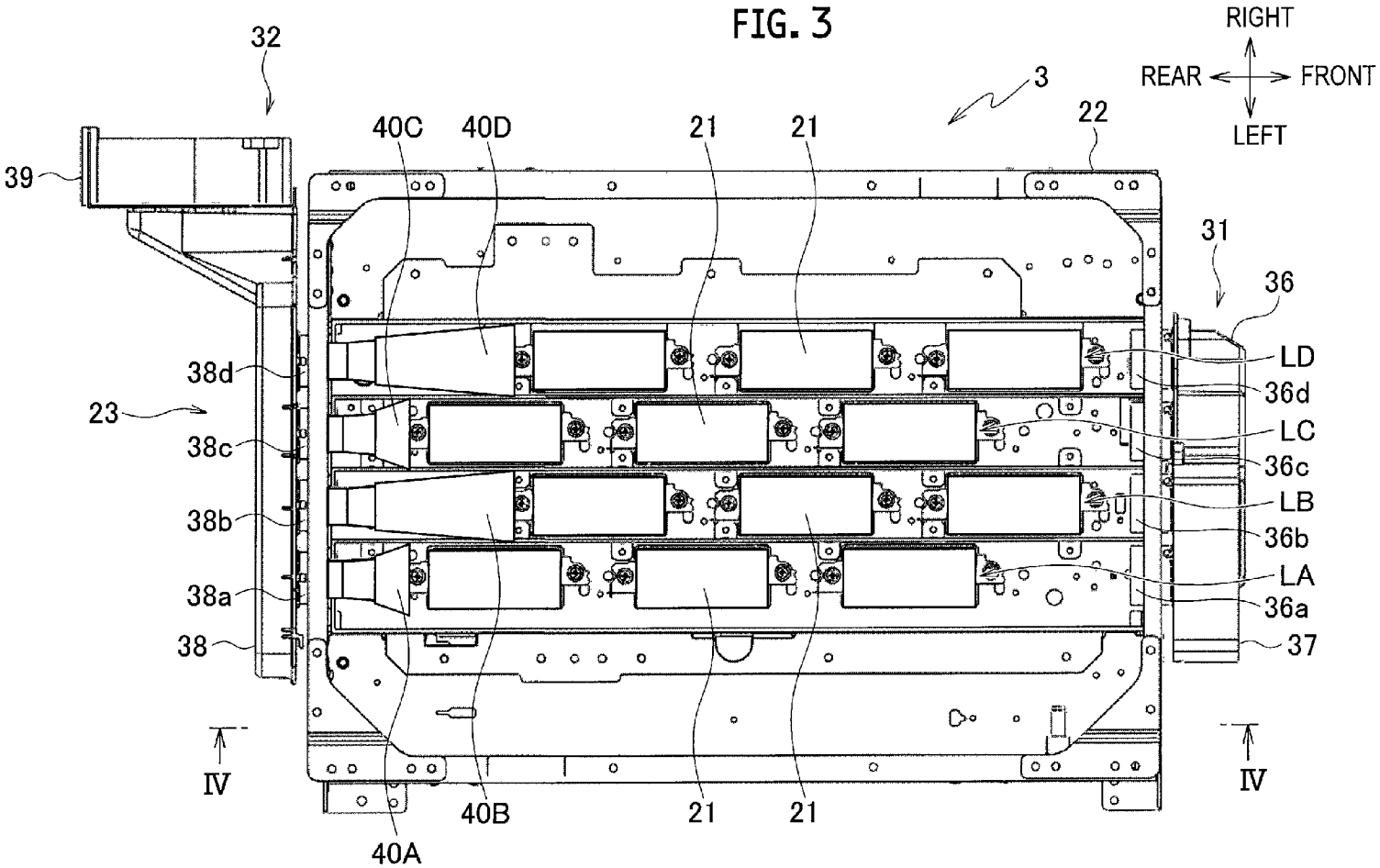
FIG. 3 is a plan view of the print unit.
Figure 4:
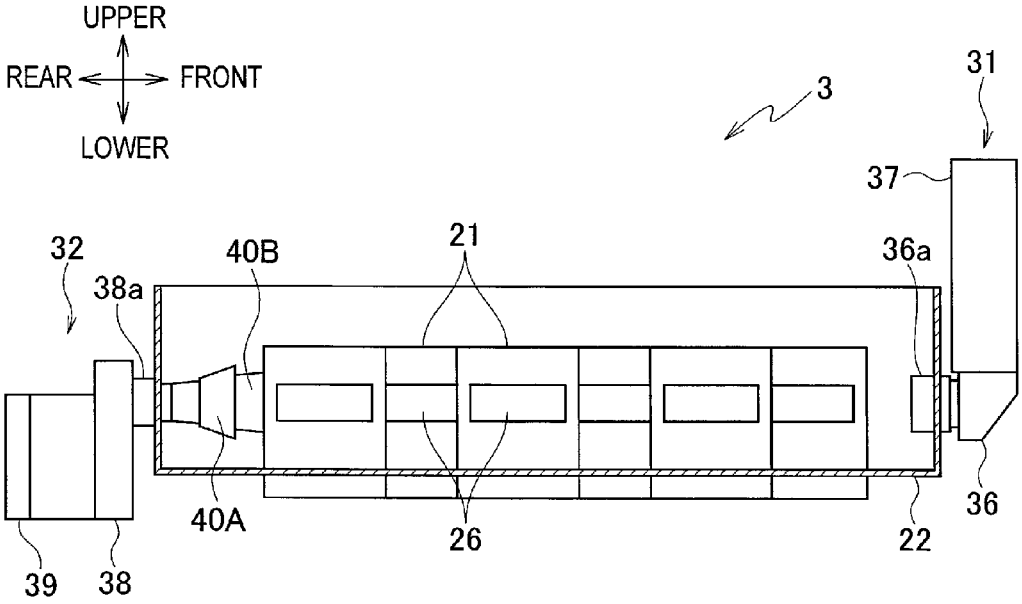
FIG. 4 is a cross-sectional side view taken along a line IV-IV shown in FIG. 3.

The inkjet heads 21 print images by ejecting inks onto the paper P. The inkjet heads 21 are arranged to form plural head rows each of which extends in the front-rear direction (a primary sweep direction) that is a head alignment direction. In the present embodiment, as shown in FIG. 2 and FIG. 3, the twelve inkjet heads 21 form the four head rows LA to LD that are aligned parallel to each other in the left-right direction (a secondary direction).

Each of the head rows LA to LD includes the three inkjet heads 21 that are aligned along the front-rear direction at constant pitches. Each of the inkjet heads 21 in the head rows LA to LD is arranged so that its position in the front-rear direction is shifted by a half of the pitch with respect to the inkjet heads 21 in the neighboring head row(s). Therefore, the twelve inkjet heads 21 are arranged in a staggered manner.

Each of the inkjet heads 21 includes plural nozzles (not shown in the drawings), piezo elements (not shown in the drawings) for ejecting inks from the nozzles, a drive circuit (not shown in the drawings) for driving the piezo elements, and a heat radiator 26. The heat radiator 26 radiates heats generated when driving the drive circuit to the outside of the inkjet head 21. The heat radiator 26 is disposed on the left side face of the inkjet head 21.

The head holder 22 holds the inkjet heads 21. The head holder 22 is formed to have an almost hollow cuboid shape. The head holder 22 is provided with a lid (not shown in the drawings) for closing its top. Plural openings are formed on a bottom plate of the head holder 22, and the inkjet heads 21 are installed in the openings. The head holder 22 holds the inkjet heads 21 so that each lower end of the inkjet heads 21 is protruded downward through the opening.

The head cooler 23 cools the inkjet heads 21 by cooling air flows. The head cooler 23 includes a blower 31 and an aspirator 32.

The blower 31 blows air onto the inkjet heads 21. The blower 31 is disposed on the front side of the head holder 22. The blower 31 includes a blower chamber 36 and a blower fan 37.

The blower chamber 36 distributes an air flow generated by the blower fan 27 to the head rows LA to LD. The blower chamber 36 is formed to have a hollow shape elongated in the left-right direction. Four blower ports 36*a* to 36*d* (see FIG. 3) are formed on the blower chamber 36.

The blower ports 36*a* to 36*d* are flow-out ports of air from the blower chamber 36. The blower ports 36*a* to 36*d* are opened toward the inside of the head holder 22. The blower ports 36*a* to 36*d* are disposed on extended lines of the head rows LA to LD, respectively, and on the front side of the head rows LA to LD.

The blower fan 37 blows air into the blower chamber 36. Therefore, air is blown to the head rows LA to LD from the front side through the blower ports 36*a* to 36*d* of the blower chamber 36.

The aspirator 32 aspirates air from the head holder 22. The aspirator 32 is disposed on the rear side of the head holder 22. The aspirator 32 includes an aspirator chamber 38, an aspirator fan 39, and ducts 40A to 40D.

The aspirator chamber 38 forms an air flow passage between the head holder 22 and the aspirator fan 39. The aspirator chamber 38 is formed to have a hollow shape elongated in the left-right direction. Four aspirator ports 38*a* to 38*d* (see FIG. 3) are formed on the aspirator chamber 38.

The aspirator ports 38*a* to 38*d* are flow-in ports of air to the aspirator chamber 38. The aspirator ports 38*a* to 38*d* are opened toward the inside of the head holder 22. The aspirator ports 38*a* to 38*d* are disposed on extended lines of the head rows LA to LD, respectively, and on the rear side of the head rows LA to LD. Namely, the aspirator ports 38*a* to 38*d* are disposed oppositely to the blower ports 36*a* to 36*d*, respectively.

The aspirator fan 39 aspirates air from one end of the aspirator chamber 38. Therefore, air is aspirated from the head holder 22 through the aspirator ports 38*a* to 38*d* of the aspirator chamber 38.

The ducts 40A to 40D restrict dispersions of the cooling air flows from the blower ports 36*a* to 36*d* to the aspirator ports 38*a* to 38*d* to improve straightness of the cooling air flows. The ducts 40A to 40D are attached to the aspirator ports 38*a* to 38*d*, respectively. Each of the ducts 40A to 40D is formed to have a tubular shape extending from the aspirator port(s) 38*a* to 38*d* to a side of the head row(s) LA to LD (to the front side). Each of the ducts 40A to 40D is extended closely to the rearmost inkjet head 21 in the corresponding head row LA to LD. Each of the ducts 40A to 40D has a truncated hollow cone whose outer diameter gradually increases toward the front side. The ducts 40A to 40D are disposed so that an opening of each front end (upstream end) of the ducts 40A to 40D overlaps at least part of the heat radiator(s) 26 of the inkjet head(s) 21 when viewing the opening perpendicularly.

Next, operations of the inkjet printer 1 will be described.

When carrying out printing in the inkjet printer 1, the drive roller 12 and the paper suctioning fan 16 are started to be driven. By driving the drive roller 12, the transfer belt 11 is fed circularly in a clockwise direction in FIG. 1. By driving the paper suctioning fan 16, air is suctioned through the belt holes of the transfer belt 11, and thereby suction forces are generated at the belt holes.

Figure 5:
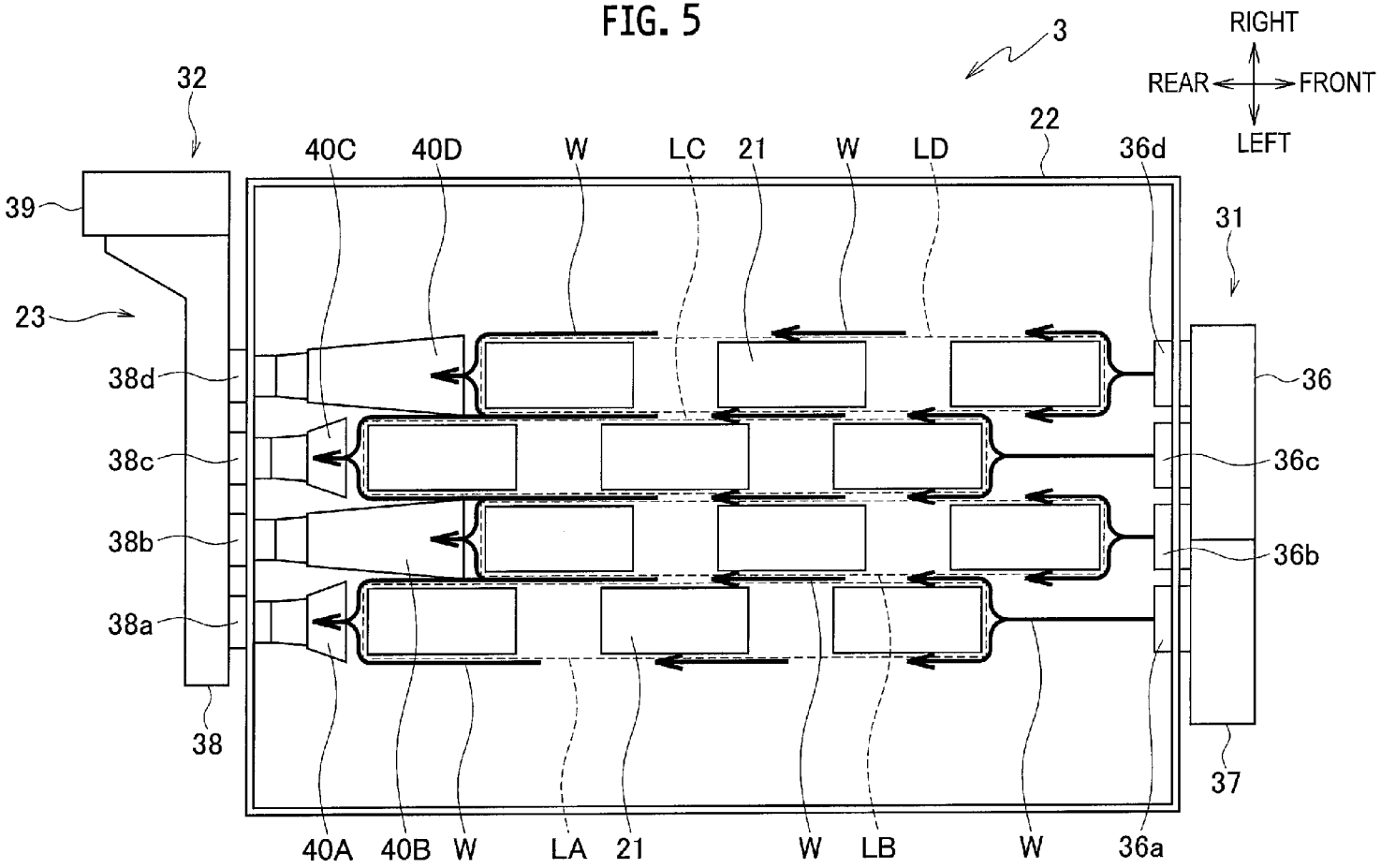
FIG. 5 is a plan view showing air flows in a head holder of the print unit.
Figure 6:
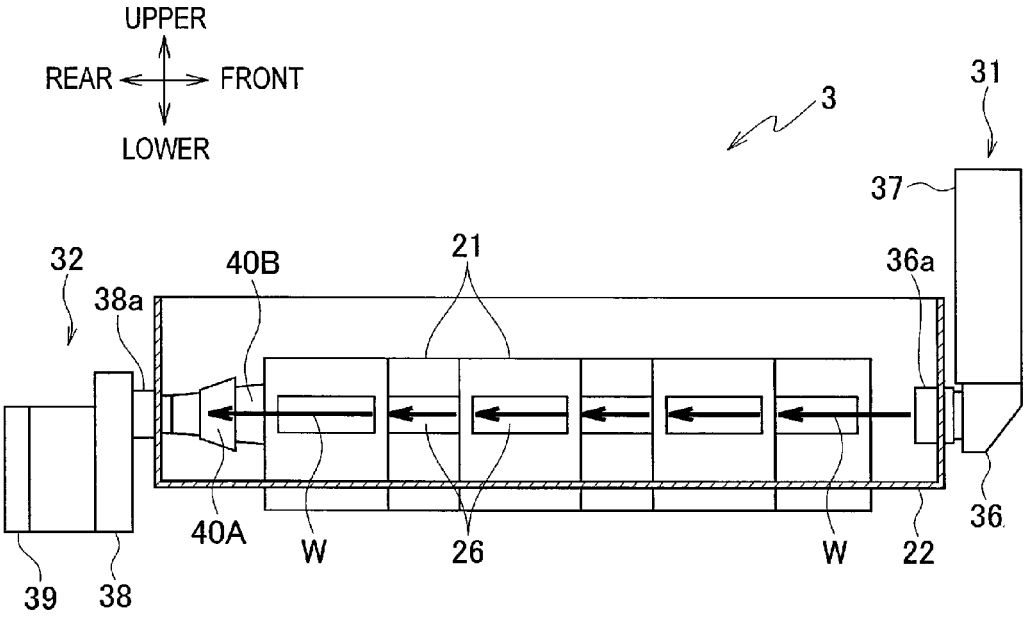
FIG. 6 is a cross-sectional side view showing the air flows in the head holder.

In addition, the blower fan 37 and the aspirator fan 39 are started to be driven. By driving the blower fan 37, air is blown toward the head rows LA to LD through the blower ports 36*a* to 36*d* of the blower chamber 36. By driving the aspirator fan 39, air is aspirated from the head holder 22 through head rows LA to LD and the aspirator ports 38*a* to 38*d* of the aspirator chamber 38. Therefore, as shown in FIG. 5 and FIG. 6, cooling air flows W are generated from the front side toward the rear side within the head holder 22.

When a paper P is fed from a feeder (not shown in the drawings) to the transfer unit 2, the paper P is transferred while being suctioned onto the transfer belt 11 by the suction forces at the belt holes. The inkjet heads 21 print images by ejecting inks onto the paper P being transferred. If the preset number of papers P to be printed is plural, the inkjet heads 21 print images by ejecting inks onto each of the papers P that are sequentially fed and then transferred on the transfer belt 11.

When the inkjet heads 21 are driven, the inkjet heads 21 generate heats. In the inkjet printer 1, the inkjet heads 21 are cooled by the cooling air flows W.

The cooling air flows W may disperse when striking the inkjet heads 21. Therefore, if the ducts 40A to 40D are not provided in contrast to the present embodiment, the closer to the downstream side (the rear side), the weaker the cooling air flows W that strike the inkjet heads 21 may become. In addition, the cooling air flows W are warmed by the heats radiated from the inkjet heads 21. Therefore, the closer to the downstream side (the rear side), the higher the temperature of the cooling air flows W becomes. Namely, if the ducts 40A to 40D are not provided, the closer to the downstream side (the rear side), the worse the performance for cooling the inkjet heads 21 becomes and thereby their temperature tends to increase.

On the other hand, in the inkjet printer 1 according to the present embodiment, the dispersion of the cooling air flows W is restricted by aspirating air by the aspirator 32 through the ducts 40A to 40D, and thereby straightness of the cooling air flows W can be improved. Therefore, the cooling air flows W congregate toward the ducts 40A to 40D, and their flow speed increases. As the result, the closer to the downstream side (the rear side), the more effectively the performance for cooling the inkjet heads 21 can be restricted from degrading.

In addition, since the opening of each front end (upstream end) of the ducts 40A to 40D overlaps at least part of the heat radiator(s) 26 of the inkjet head(s) 21 when viewing the opening perpendicularly, the flow speed of the cooling air flows W that contact with the heat radiators 26 of the inkjet heads 21 can be increased. Therefore, the inkjet heads 21 can be cooled more effectively.

The printed paper(s) P is transferred through the transfer unit 2, and then ejected onto a paper ejector (not shown in the drawings). When the last paper P is ejected, the drive roller 12, the paper suctioning fan 16, the blower fan 37, and the aspirator fan 39 are stopped. In this manner, the printing operations are finished.

As described above, in the inkjet printer 1, the aspirator 32 includes the tubular ducts 40A to 40D extending from the aspirator ports 38*a* to 38*d* to a side of the head rows LA to LD. Since the aspirator 32 aspirates air through the ducts 40A to 40D, the cooling air flows W congregate towards the ducts 40A to 40D and their flow speed can be increased. As the result, the efficiency for cooling the inkjet heads 21 can be improved.

Second Embodiment

A second embodiment whose print unit is modified from the above first embodiment will be described hereinafter.

Figure 7:
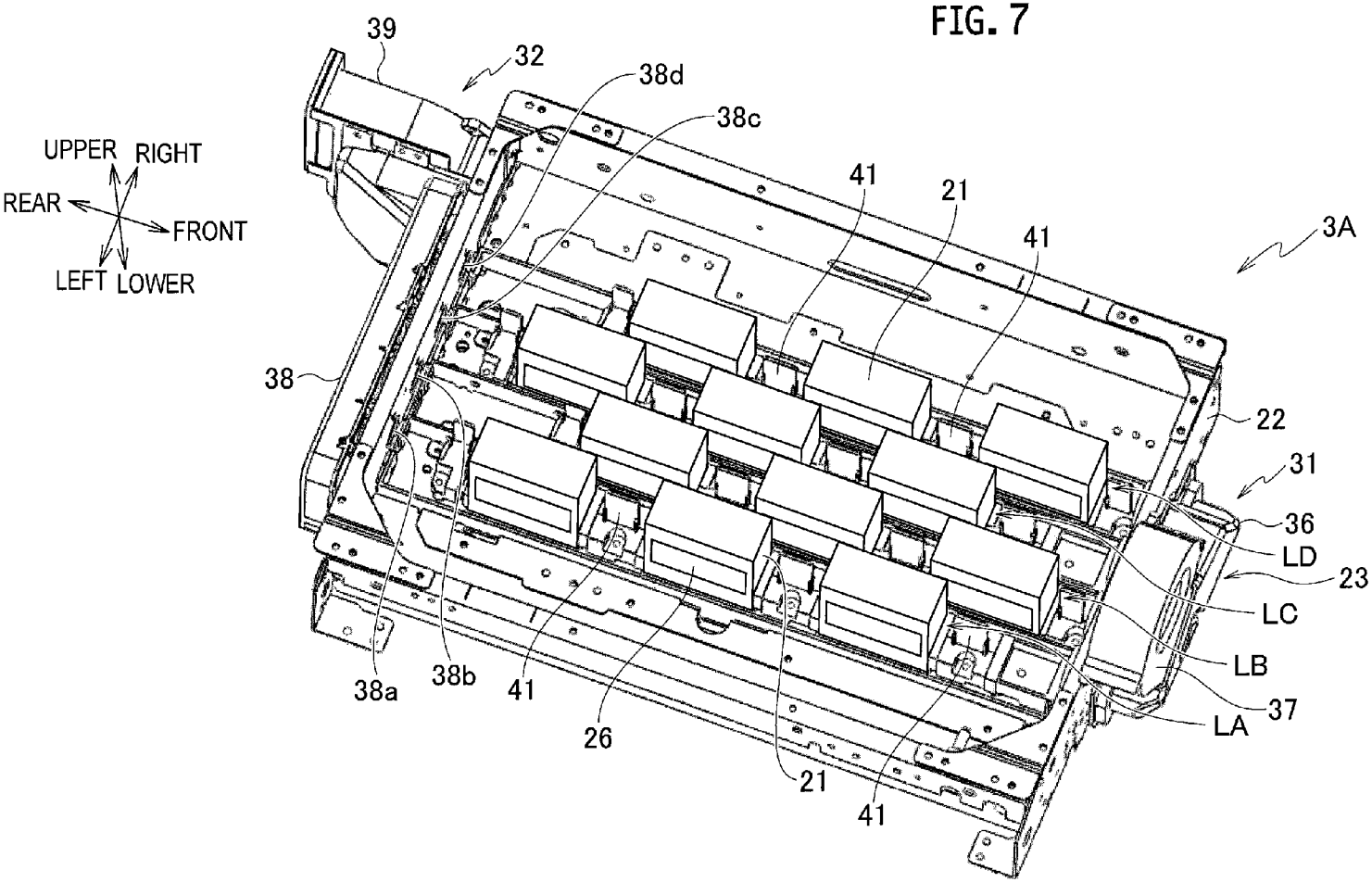
FIG. 7 is a perspective view of a print unit in a second embodiment.
Figure 8:
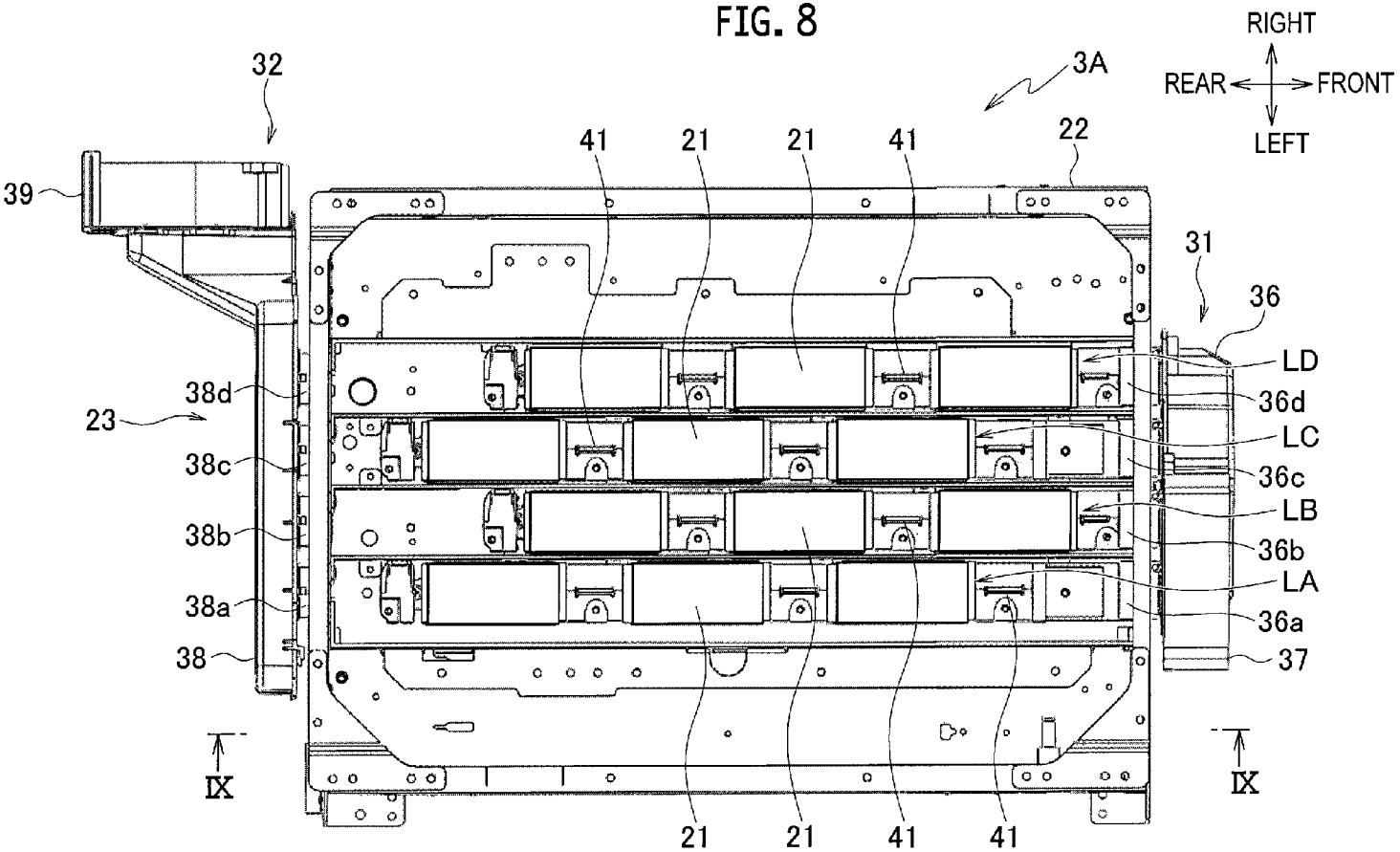
FIG. 8 is a plan view of the print unit.
Figure 9:
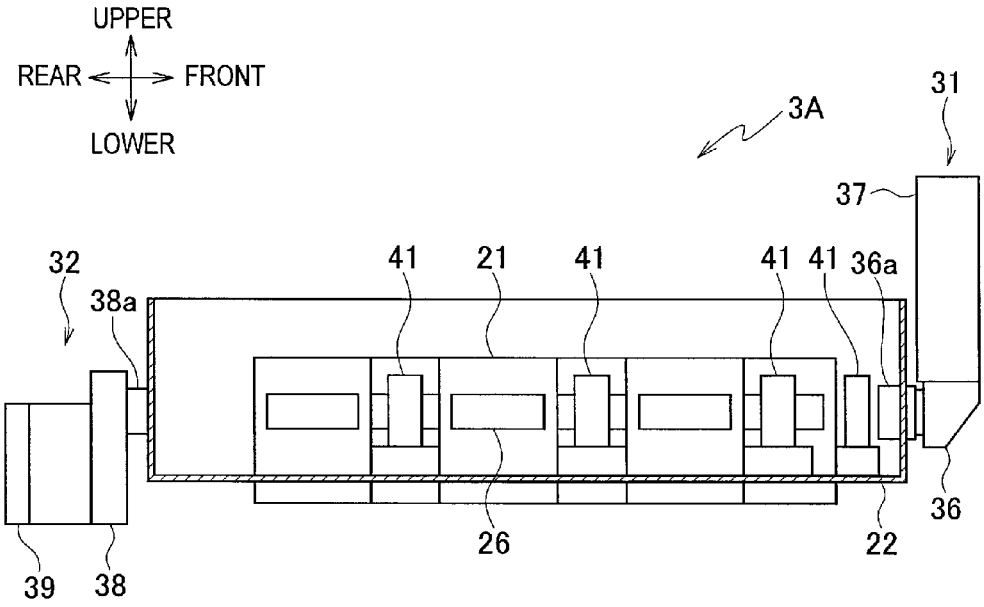
FIG. 9 is a cross-sectional side view taken along a line IX-IX shown in FIG. 8.

As shown in FIG. 7 to FIG. 9, compared with the print unit 3 in the above first embodiment, in a print unit 3A of the present embodiment, the ducts 40A to 40D are omitted, and plural straightening tabs 41 are provided.

The straightening tabs 41 are members for straightening the cooling air flows W in order to restrict the dispersion of the cooling air flows W. Each of the straightening tabs 41 is formed to have a plate shape that is perpendicular to a horizontal plane and parallel to the primary sweeping direction. Each of the straightening tabs 41 is disposed on each upstream side of the inkjet heads 21. Namely, the straightening tabs 41 are disposed between neighboring two inkjet heads 21 in the head rows LA to LD, and disposed on each upstream side of the most-upstream inkjet heads 21 in the head rows LA to LD.

Figure 10:
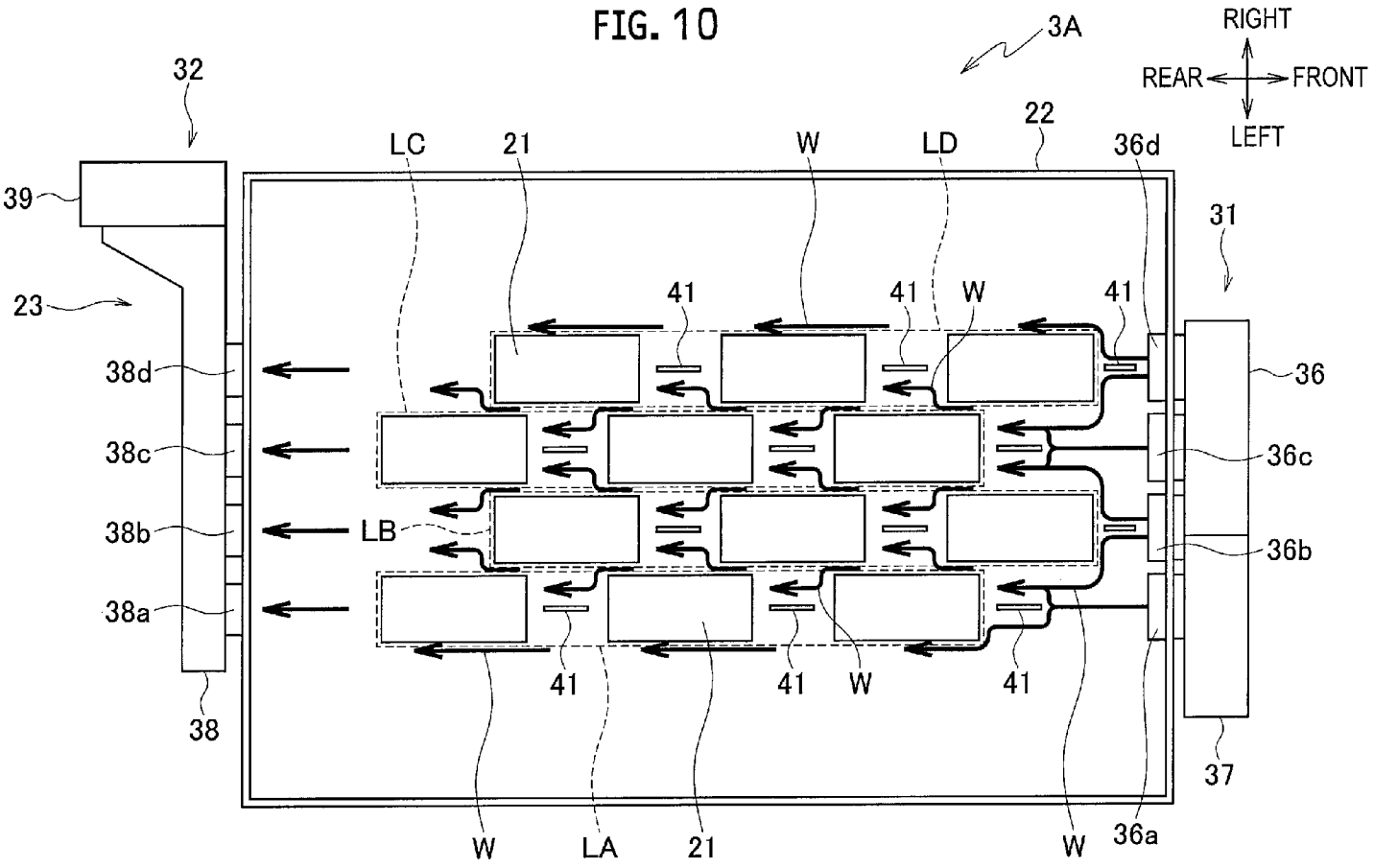
FIG. 10 is a plan view showing air flows in a head holder of the print unit.

In the print unit 3A, when the blower fan 37 and the aspirator fan 39 are driven, the cooling air flows W flow in the head holder 22 as shown in FIG. 10.

As shown in FIG. 10, in the print unit 3A, the straightening tabs 41 restrict the cooling air flows W after striking the inkjet heads 21 from deviating in the left-right direction (deviating leftward or rightward). For example, part of the cooling air flow W that strikes the most-upstream inkjet head 21 in the head row LB flows leftward, and then the part of the cooling air flow W is deflected rearward by the straightening tab 41 disposed on an upstream side of the most-upstream inkjet head 21 in the head row LA. Namely, the part of the cooling air flow W that might deviate further leftward from the head row LA if no straightening tab 41 were provided can be deflected by the straightening tab 41 to strike the most-upstream inkjet head 21 in the head row LA.

As described above, according to the second embodiment, the dispersion of the cooling air flows W can be restricted by the straightening tabs 41, and thereby losses of the cooling air flows W can be reduced. Therefore, the efficiency for cooling the inkjet heads 21 can be improved.

Third Embodiment

A third embodiment whose print unit is modified from the above embodiments will be described hereinafter.

Figure 11:
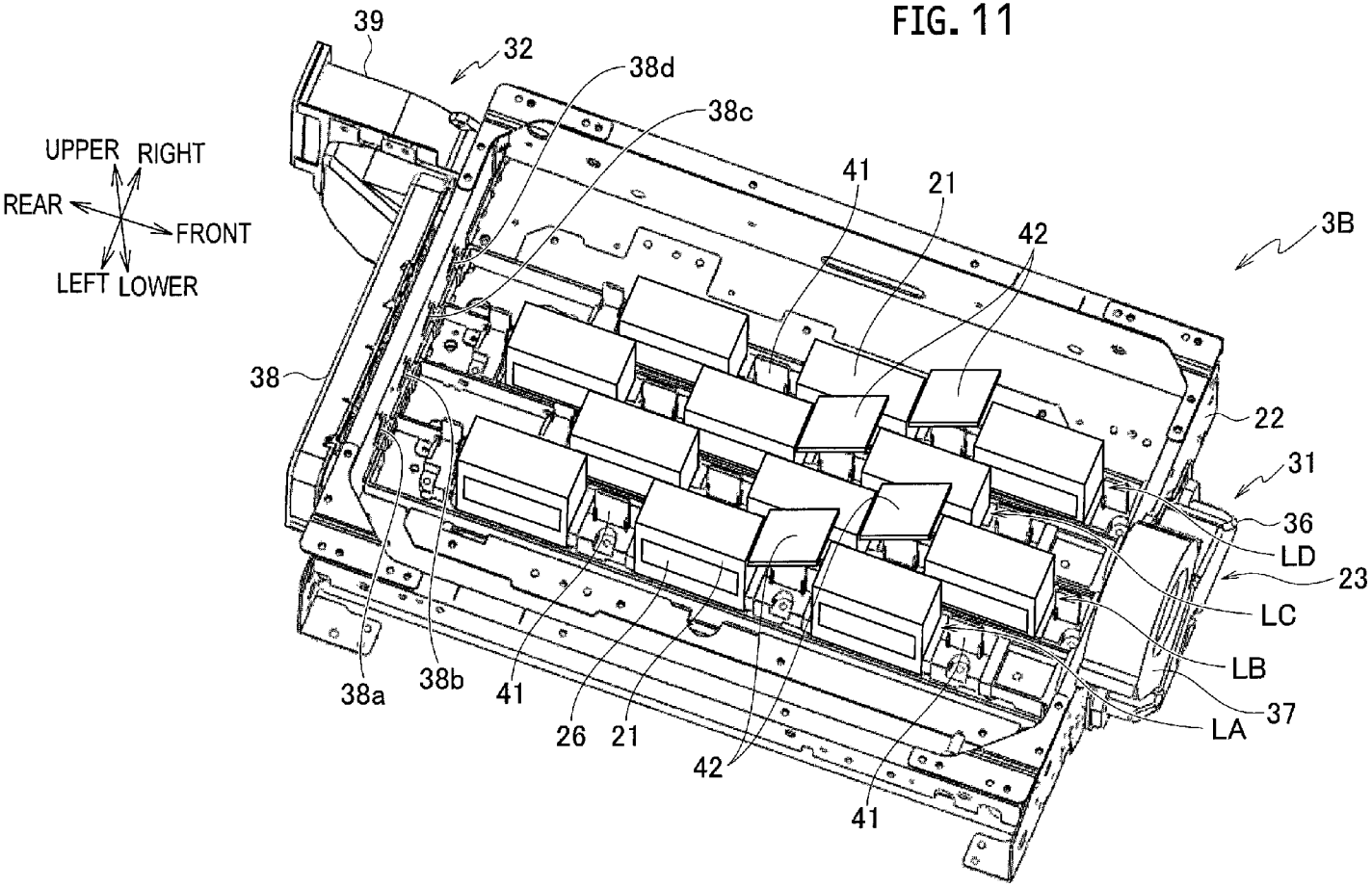
FIG. 11 is a perspective view of a print unit in a third embodiment.
Figure 12:
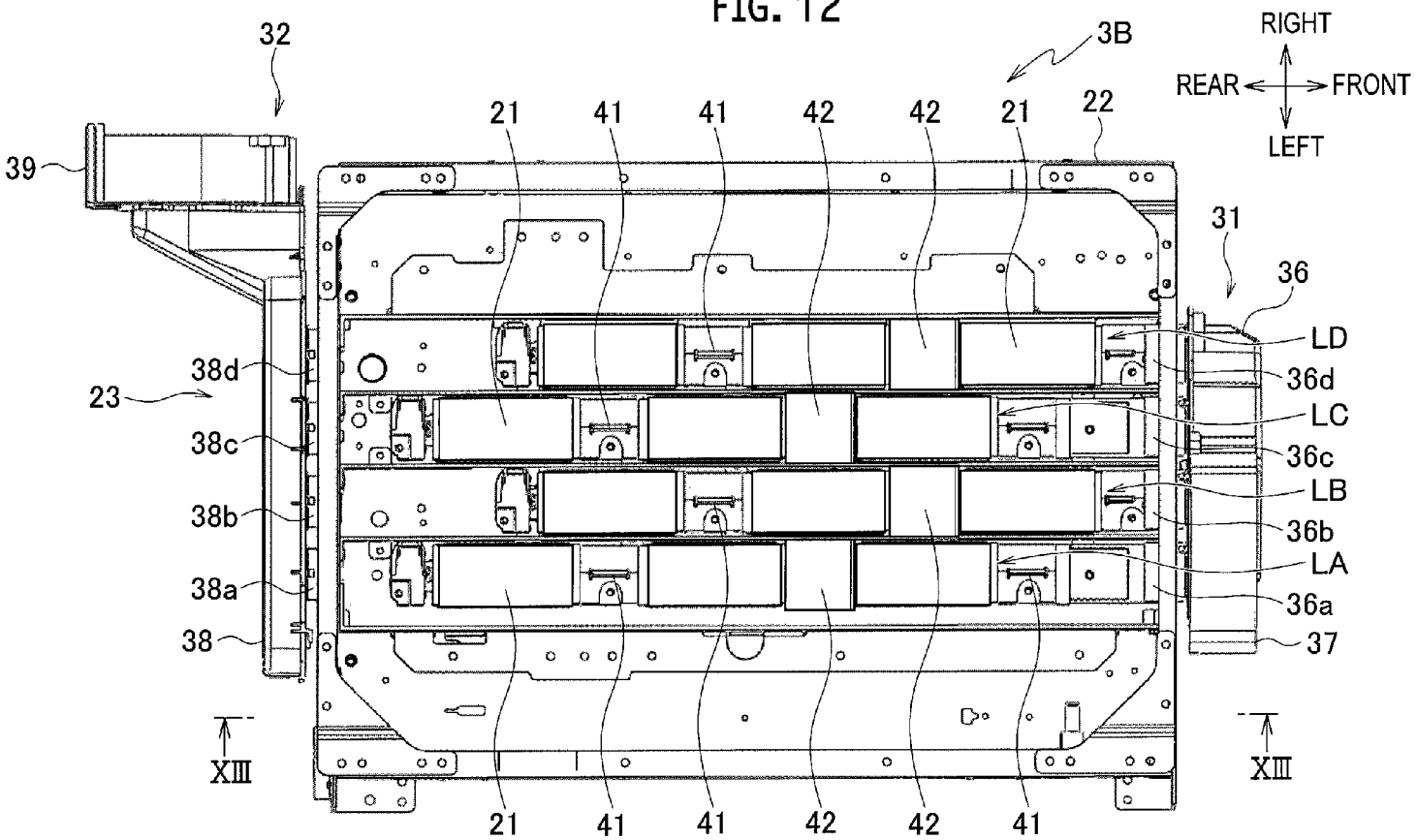
FIG. 12 is a plan view of the print unit.
Figure 13:
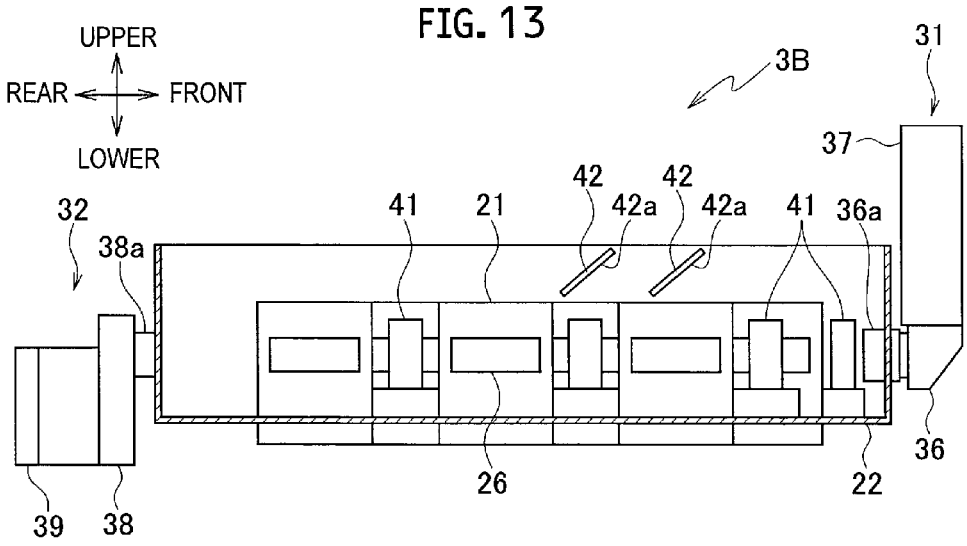
FIG. 13 is a cross-sectional side view taken along a line XIII-XIII shown in FIG. 12.

As shown in FIG. 11 to FIG. 13, compared with the print unit 3A in the above second embodiment, in a print unit 3B of the present embodiment, plural plate-shaped inclined members 42 are further provided. The inclined members 42 may be extended obliquely downward from the lid (not shown in the drawings) that closes the top of the head holder 22, or may be attached to a top of the straightening tabs 41 extended upward.

The inclined members 42 guide cooling air flows W flowing above the head rows LA to LD to deflect the cooling air flows W downward into the head rows LA to LD. The inclined members 42 are disposed above the hear rows LA to LD. In the front-rear direction, each of the inclined members 42 is disposed on the front side (an upstream side) of the center inkjet head 21 in each of the head rows LA to LD. In the other words, in the front-rear direction, each of the inclined members 42 is disposed on the rear side (a downstream side) of the most-upstream inkjet head 21 in each of the head rows LA to LD. Each of the inclined members 42 has an inclined surface 42*a* (see FIG. 13) that is inclined so that its front side is made higher than its rear side.

Figure 14:
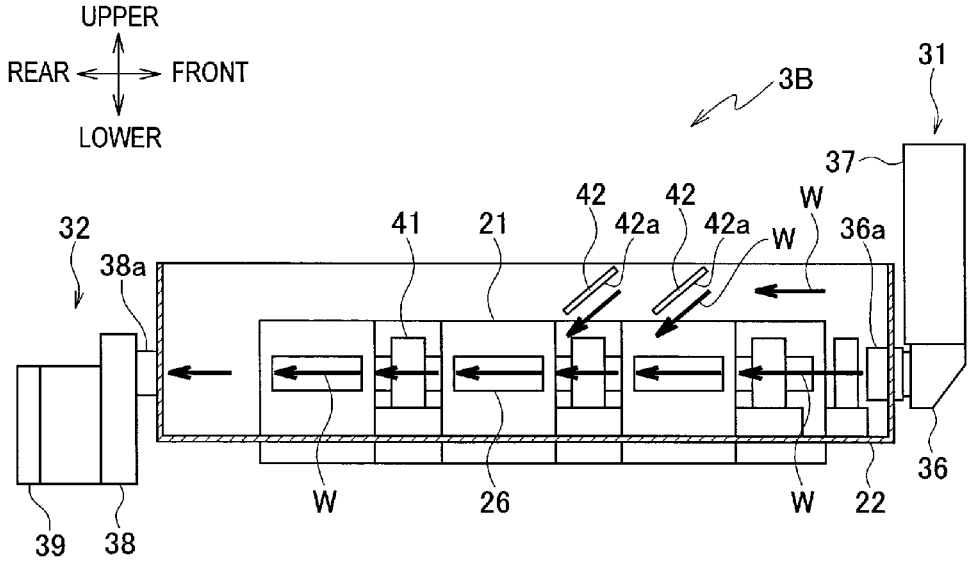
FIG. 14 is a cross-sectional side view showing air flows in a head holder of the print unit.

In the print unit 3B, as shown in FIG. 14, the cooling air flows W flowing above the head rows LA to LD strike the inclined surfaces 42*a* of the inclined member 42, and thereby the cooling air flows W are flown (deflected) downward along the inclined surfaces 42*a* so as to be guided into the head rows LA to LD. Therefore, the cooling air flows W flowing in the head lows LA to LD are made strong, and thereby the efficiency for cooling the inkjet heads 21 can be improved.

As already described above, the closer to the rear side (the downstream side), the higher the temperature of the cooling air flows W becomes. Since each of the inclined members 42 is disposed on the rear side of the most-upstream inkjet head 21 in each of the head rows LA to LD, the relatively low-temperature cooling air flows W can be introduced into the head rows LA to LD from above.

As described above, according to the third embodiment, the cooling air flows W flowing above the head rows LA to LD are introduced into the head rows LA to LD by the inclined members 42. Therefore, the efficiency for cooling the inkjet heads 21 can be further improved.

Fourth Embodiment

A fourth embodiment whose print unit is modified from the above embodiments will be described hereinafter.

Figure 15:
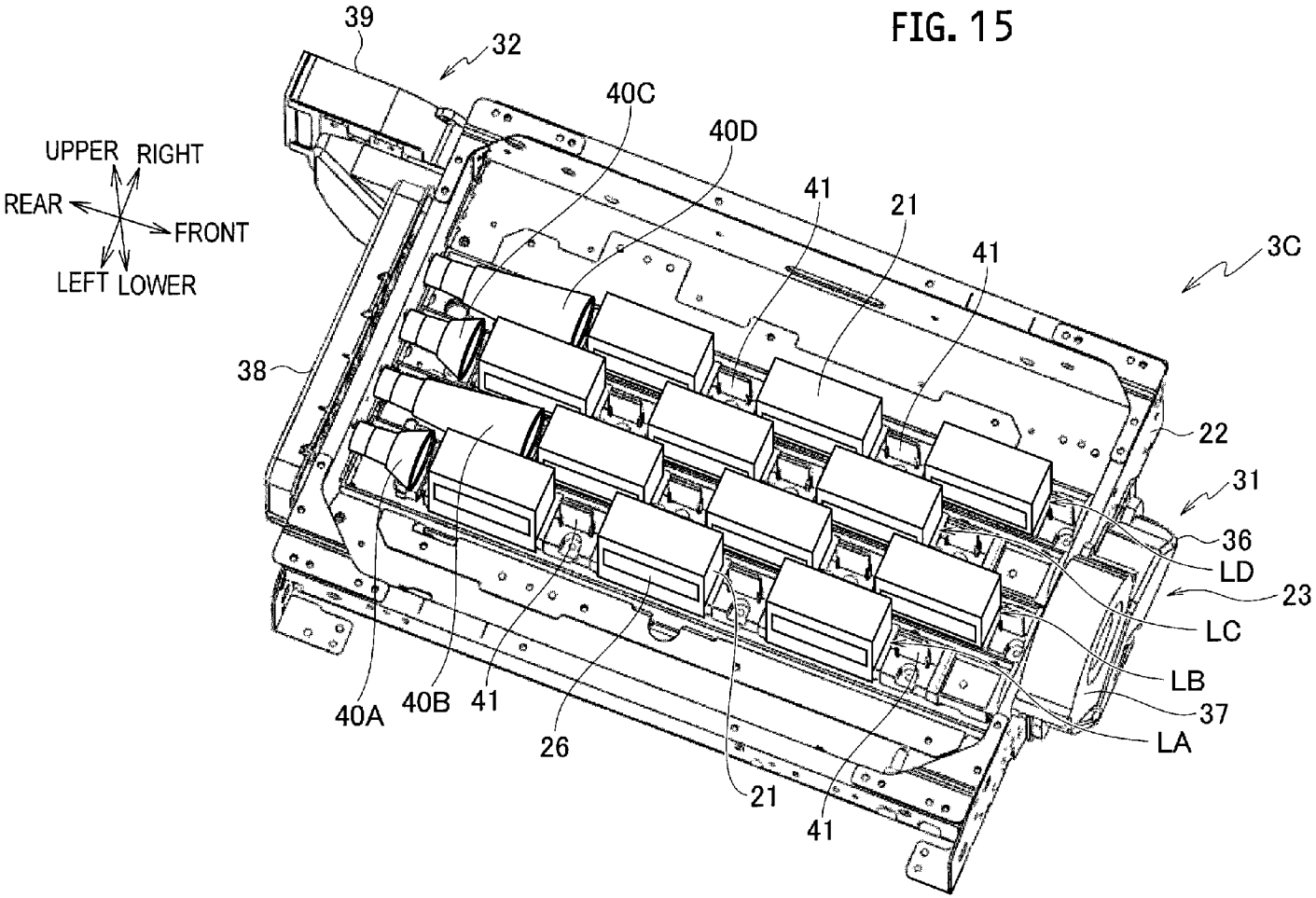
FIG. 15 is a perspective view of a print unit in a fourth embodiment.
Figure 16:
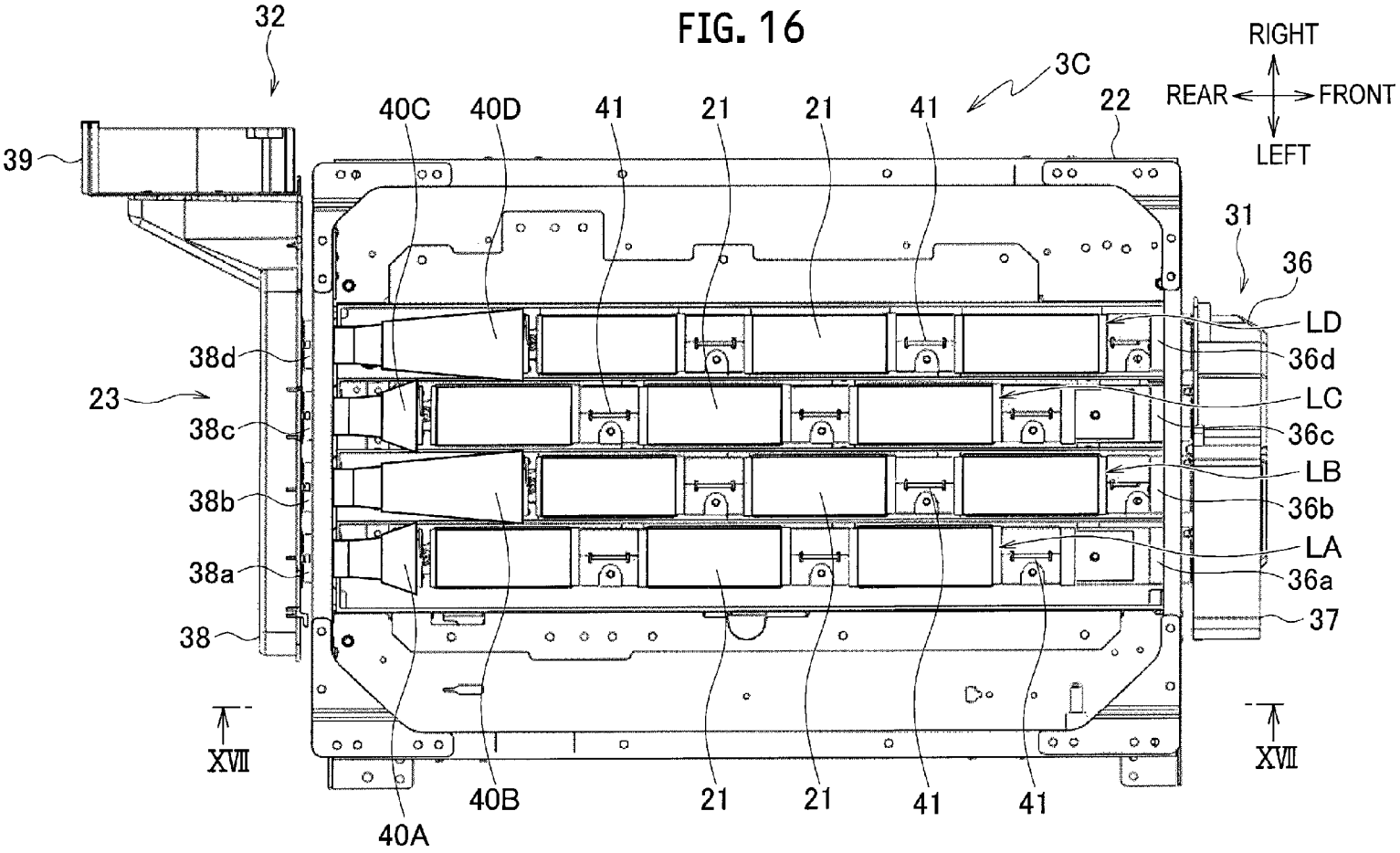
FIG. 16 is a plan view of the print unit.
Figure 17:
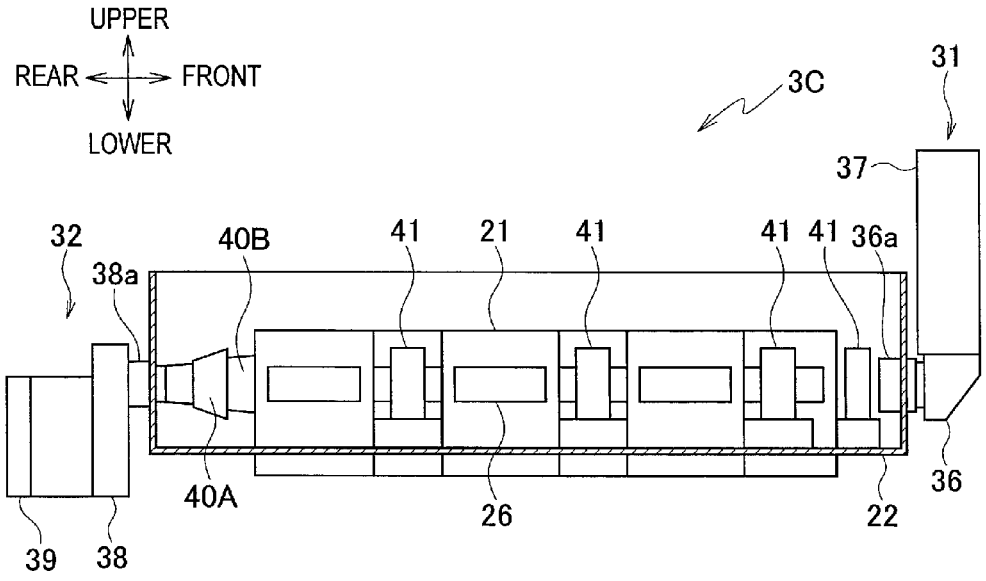
FIG. 17 is a cross-sectional side view taken along a line XVII-XVII shown in FIG. 16.

As shown in FIG. 15 to FIG. 17, compared with the print unit 3 in the above first embodiment, in a print unit 3C of the present embodiment, the plural straightening tabs 41 equivalent in the second embodiment further provided.

Figure 18:
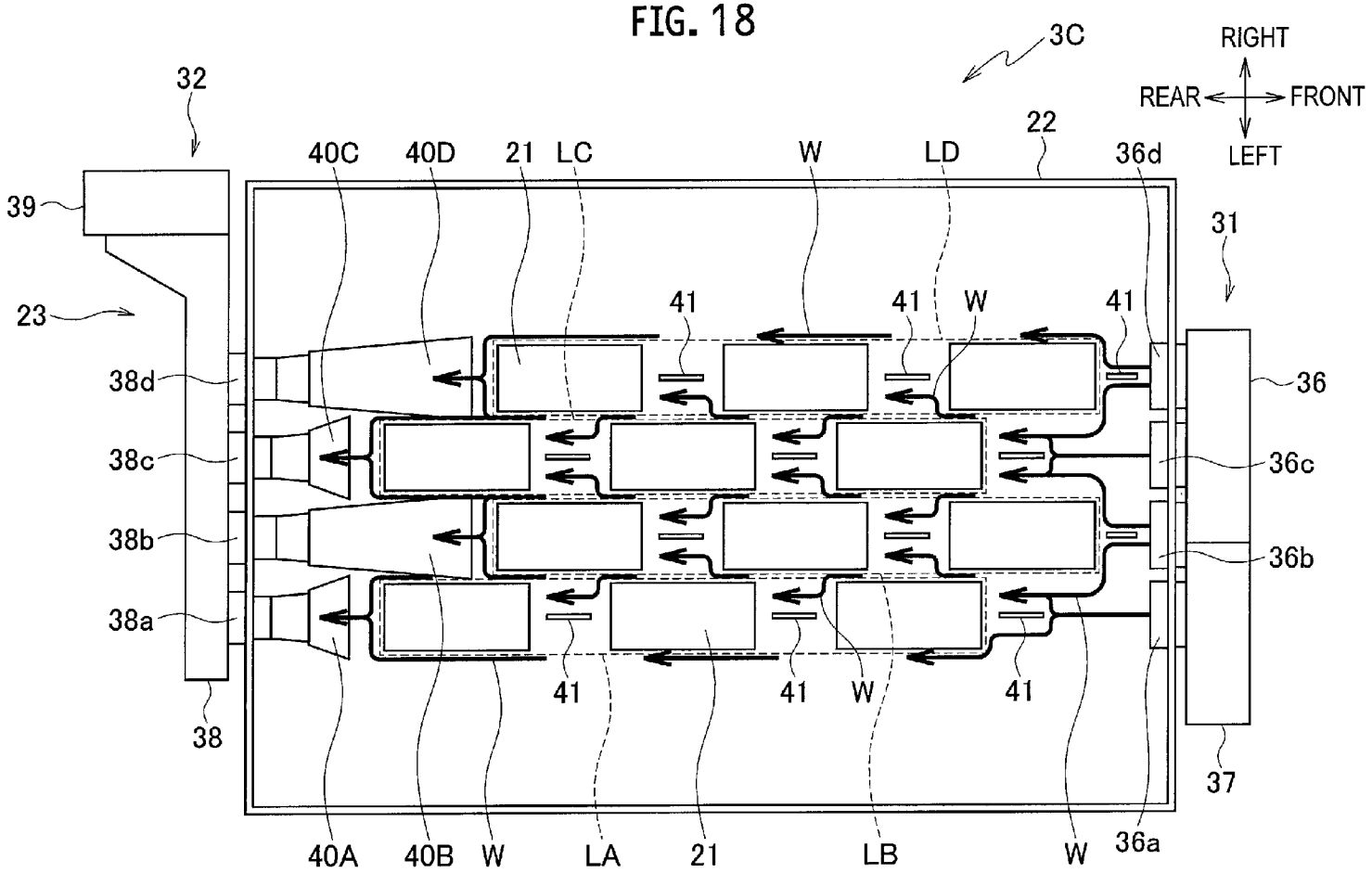
FIG. 18 is a plan view showing air flows in a head holder of the print unit.

In the print unit 3C, when the blower fan 37 and the aspirator fan 39 are driven, the cooling air flows W flow in the head holder 22 as shown in FIG. 18.

As shown in FIG. 18, in the print unit 3C, the straightening tabs 41 restrict the cooling air flows W after striking the inkjet heads 21 from deviating in the left-right direction (deviating leftward or rightward) similarly to the print unit 3A in the above second embodiment. Therefore, the dispersion of the cooling air flows W can be restricted, and thereby losses of the cooling air flows W can be reduced.

In addition, in the print unit 3C, the dispersion of the cooling air flows W is restricted by aspirating air by the aspirator 32 through the ducts 40A to 40D, and thereby straightness of the cooling air flows W can be improved similarly to the print unit 3 in the above first embodiment. Therefore, the cooling air flows W congregate toward the ducts 40A to 40D, and their flow speed increases. As the result, the closer to the downstream side (the rear side), the more effectively the performance for cooling the inkjet heads 21 can be restricted from degrading.

Since the ducts 40A to 40D and the straightening tabs 41 are adopted together, the efficiency for cooling the inkjet heads 21 can be further improved.

Other Embodiments

As described above, the present invention is described by taking the above first to fourth embodiments for instances, but it should be understood that the descriptions and the drawings that form part of the above disclosures never limit the present invention. For a person ordinarily skilled in the art, various alternative embodiments, practical examples, and operational techniques may be revealed from the above disclosures.

In the above third embodiment, the inclined members 42 are provided for the head rows LA to LD one by one, but the plural inclined members 42 may be provided for each of the head rows LA to LD. For example, the inclined members 42 may be disposed on the upstream sides of all the inkjet heads 21, respectively.

In the fourth embodiment, the inclined members 42 of the third embodiments may be additionally provided in the print unit 3C.

As these examples, it is obvious that the present invention includes various embodiments and so on that are not disclosed here. Therefore, the technical scope of the present invention is determined only by inventive specific matters in the Claims that are reasonable from the above disclosures.

The present application claims the benefit of priorities under 35 U.S.C. §119 to Japanese Patent Application No. 2015-191004, filed on Sep. 29, 2015, and Japanese Patent Application No. 2015-191008, filed on Sep. 29, 2015, the entire contents of which are incorporated herein by reference.

What is claimed is:

1. An inkjet printer comprising:

a plurality of inkjet heads that are aligned in a head alignment direction perpendicular to a paper transport direction to form a head row;

a blower that blows air to the head row, the blower being disposed at one side of the head row along the head alignment direction and the blower blowing air in the head alignment direction; and an aspirator that is disposed on an extended line of the head row and on the other side of the head row along the head alignment direction, and aspirates air through an aspirator port thereof, wherein the aspirator includes a tubular duct that extends from the aspirator port toward the head row.

2. The inkjet printer according to claim 1, further comprising a head holder that holds the plurality of inkjet heads and is provided with a plurality of openings, lower ends of the plurality of inkjet heads being protruded downward through the plurality of openings, respectively, wherein the blower blows the air toward an inside of the head holder, and the aspirator aspirates the air from the inside of the head holder through the aspirator port which is opened toward the inside of the head holder.

3. An inkjet printer comprising:

a plurality of inkjet heads that are aligned in a head alignment direction to form a head row;

a blower that blows air to the head row from one side along the head alignment direction; and an aspirator that is disposed on an extended line of the head row and on the other side along the head alignment direction, and aspirates air through an aspirator port thereof, wherein the aspirator includes a tubular duct that extends from the aspirator port toward the head row, the head row is provided in a plurality, the plurality of inkjet heads in the plurality of head rows is arranged in a staggered manner, and the inkjet printer further comprises a plurality of plate-shaped straitening tabs each of which is disposed on a side of the one side of each of the inkjet heads in the head alignment direction, and is perpendicular to a horizontal plane and parallel to the head alignment direction.

4. The inkjet printer according to claim 3, further comprising at least one inclined member that is disposed above each of the head rows, and has an inclined surface whose one side in the head alignment direction is made higher than the other side.

5. The inkjet printer according to claim 3, further comprising a head holder that holds the plurality of inkjet heads and is provided with a plurality of openings, lower ends of the plurality of inkjet heads being protruded downward through the plurality of openings, respectively, wherein the blower blows the air toward an inside of the head holder, and the aspirator aspirates the air from the inside of the head holder through the aspirator port which is opened toward the inside of the head holder.

6. An inkjet printer comprising:

a plurality of inkjet heads that are aligned in a head alignment direction to form a head row;

a blower that blows air to the head row from one side along the head alignment direction;

an aspirator that is disposed on an extended line of the head row and on the other side along the head alignment direction, and aspirates air through an aspirator port thereof; and at least one inclined member that is disposed above the head row, and has an inclined surface whose one side in the head alignment direction is made higher than the other side, wherein the aspirator includes a tubular duct that extends from the aspirator port toward the head row.

7. The inkjet printer according to claim 6, further comprising a head holder that holds the plurality of inkjet heads and is provided with a plurality of openings, lower ends of the plurality of inkjet heads being protruded downward through the plurality of openings, respectively, wherein the blower blows the air toward an inside of the head holder, and the aspirator aspirates the air from the inside of the head holder through the aspirator port which is opened toward the inside of the head holder.

* * * * *